US008562006B2

(12) United States Patent
Alexander

(10) Patent No.: US 8,562,006 B2
(45) Date of Patent: Oct. 22, 2013

(54) INLINE SKATE WHEEL

(75) Inventor: Garnet Alexander, Beaconsfield (CA)

(73) Assignee: Bauer Hockey, Inc., Exeter, NH (US)

( * ) Notice: Subject to any disclaimer, the term of this patent is extended or adjusted under 35 U.S.C. 154(b) by 0 days.

(21) Appl. No.: 13/276,416

(22) Filed: Oct. 19, 2011

(65) Prior Publication Data

US 2013/0099457 A1 Apr. 25, 2013

(51) Int. Cl.
*B62M 1/00* (2010.01)

(52) U.S. Cl.
USPC ..... 280/87.042; 280/11.233; 301/5.7

(58) Field of Classification Search
USPC ..... 280/841, 7.13, 7.15, 11.15, 11.19, 280/11.221, 11.223, 11.231; 301/5.3, 5.7
See application file for complete search history.

(56) References Cited

U.S. PATENT DOCUMENTS

| | | | | |
|---|---|---|---|---|
| 4,838,564 | A | 6/1989 | Jarvis | |
| 5,308,152 | A * | 5/1994 | Ho | 301/5.304 |
| 5,791,665 | A | 8/1998 | Mayer, II | |
| 5,899,465 | A | 5/1999 | Mayer, II | |
| 6,131,923 | A | 10/2000 | Miotto | |
| 6,398,232 | B1 | 6/2002 | Dahan | |
| 7,311,318 | B1 * | 12/2007 | Funk et al. | 280/87.042 |

* cited by examiner

*Primary Examiner* — John Walters
*Assistant Examiner* — James Triggs

(57) ABSTRACT

A wheel for an inline skate that may reduce rolling friction and provide a wider rolling base giving more stability. The wheel comprises a hub for receiving an axle and a wheel body defining a circumference of the wheel. The wheel body comprises a circumferential surface extending along the circumference of the wheel. The circumferential surface comprises a first contact surface and a second contact surface for being in rolling contact with a skating surface on which the inline skate moves. The wheel body also comprises a receding surface extending from the first contact surface to the second contact surface and forming a recess between the first contact surface and the second contact surface.

17 Claims, 6 Drawing Sheets

INLINE SKATE WHEEL

FIELD OF THE INVENTION

The present invention relates to inline skating and, more particularly, to a wheel for an inline skate.

BACKGROUND

Inline skates are a type of roller skate used for inline skating which comprises a plurality of wheels arranged in a single line.

A conventional wheel of an inline skate may have an essentially convex circumferential surface (e.g., a U-shaped surface or partly V-shaped and partly U-shaped surface) that contacts a skating surface on which the wheel rolls in a widthwise center of the wheel. The wheel's convex circumferential surface may present certain drawbacks in some cases in terms of friction and stability on the skating surface.

For there and other reasons, there is a need for improvements in inline skate wheels.

SUMMARY OF THE INVENTION

As embodied and broadly described herein, according to an aspect of the invention, there is provided a wheel for an inline skate. The wheel comprises a hub for receiving an axle and a wheel body defining a circumference of the wheel. The wheel body comprises a circumferential surface extending along the circumference of the wheel. The circumferential surface comprises a first contact surface and a second contact surface for being in rolling contact with a skating surface on which the inline skate moves. The wheel body also comprises a receding surface extending from the first contact surface to the second contact surface and forming a recess between the first contact surface and the second contact surface.

These and other aspects of the invention will now become apparent to those of ordinary skill in the art upon review of the following description of embodiments of the invention in conjunction with the accompanying drawings.

BRIEF DESCRIPTION OF THE DRAWINGS

A detailed description of embodiments of the invention is provided herein below, by way of example only, with reference to the accompanying drawings, in which.

Figure 1:
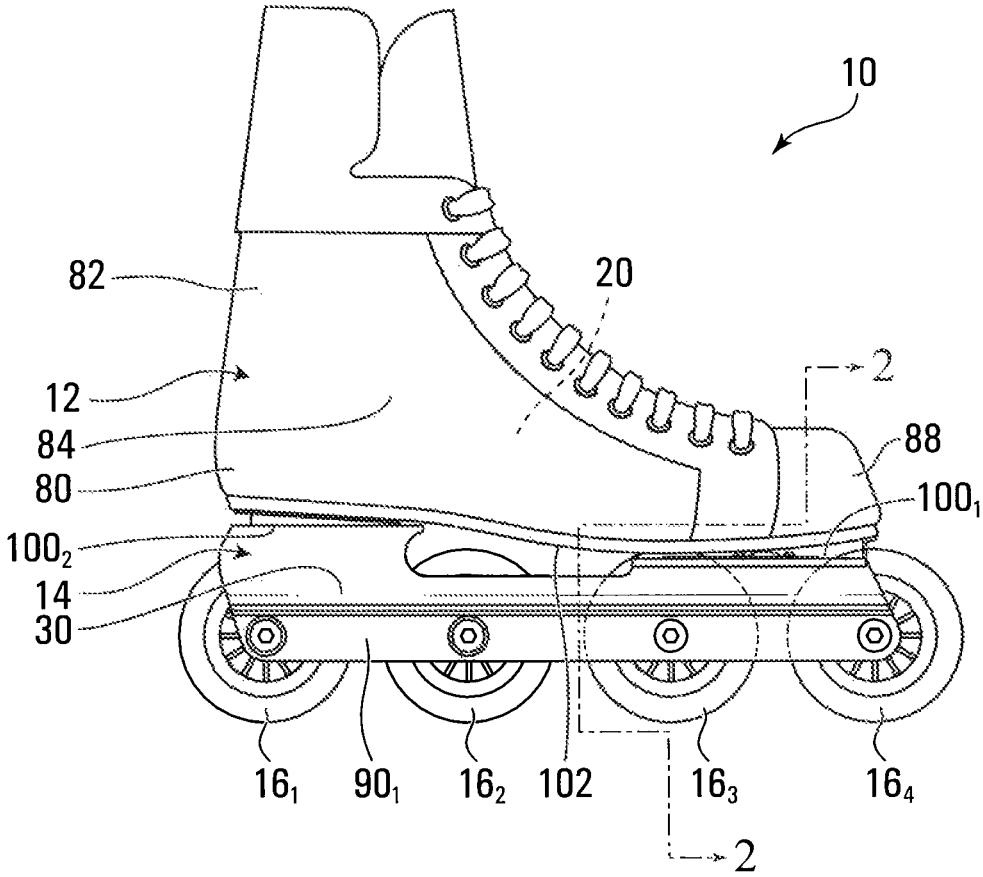
FIG. 1 is a side view of an inline skate comprising a chassis that comprises a plurality of wheels in accordance with an embodiment of the invention.

In the drawings, embodiments of the invention are illustrated by way of examples. It is to be expressly understood that the description and drawings are only for the purpose of illustration and are an aid for understanding. They are not intended to be a definition of the limits of the invention.

DETAILED DESCRIPTION OF EMBODIMENTS OF THE INVENTION

To facilitate the description, any reference numeral designating an element in one figure will designate the same element if used in any other figures. In describing the embodiments, specific terminology is resorted to for the sake of clarity but the invention is not intended to be limited to the specific terms so selected, and it is understood that each specific term comprises all equivalents.

Unless otherwise indicated, the drawings are intended to be read together with the specification, and are to be considered a portion of the entire written description of this invention. As used in the following description, the terms "horizontal", "vertical", "left", "right", "up", "down" and the like, as well as adjectival and adverbial derivatives thereof (e.g., "horizontally", "rightwardly", "upwardly", "radially", etc.), simply refer to the orientation of the illustrated structure as the particular drawing figure faces the reader. Similarly, the terms "inwardly," "outwardly" and "radially" generally refer to the orientation of a surface relative to its axis of elongation, or axis of rotation, as appropriate.

FIG. 1 shows an inline skate 10 for use by a skater in accordance with an embodiment of the invention. The inline skate 10 comprises a skate boot 12 and a chassis 14 under the skate boot 12. The chassis 14 comprises a plurality of wheels $\mathbf{16}_1$-$\mathbf{16}_4$ arranged inline. In this embodiment, the inline skate 10 is a roller hockey inline skate used for playing roller hockey. In other embodiments, the inline skate 10 may be another type of inline skate used for speed skating, recreational skating or other skating activities.

The skate boot 12 defines a cavity 20 for receiving a foot of the skater. More particularly, in this embodiment, the skate boot 12 includes a heel counter portion 80 which cups around the skater's heel, an ankle support 82 enclosing a substantial portion of the skater's ankle, a lateral quarter panel 84 and a medial quarter panel 86 extending along each side of the skater's foot and ankle, and a toe covering portion 88.

The chassis 14 is secured on an underside 102 of the skate boot 12. For example, in some embodiments, the chassis 14 may be fastened to the skate boot 12 via fasteners (e.g., screws, bolts, nuts, rivets, etc.). The chassis 14 may be secured under the skate boot 12 in various other ways in other embodiments (e.g., using an adhesive).

Figure 2:
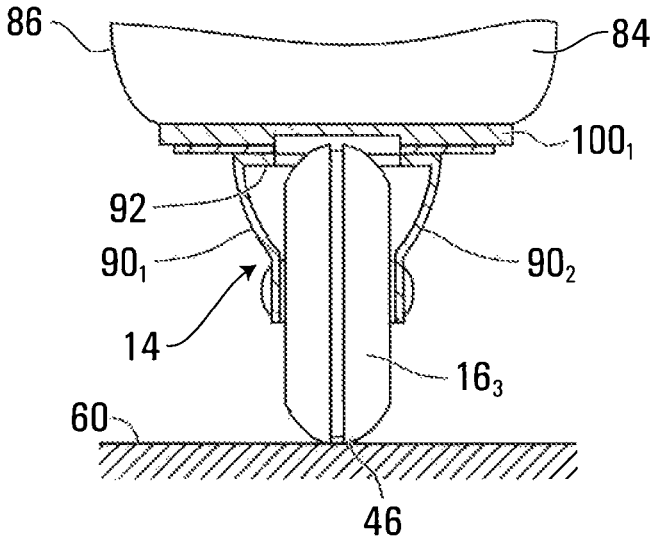
FIG. 2 is a front view of the chassis.
Figure 3:
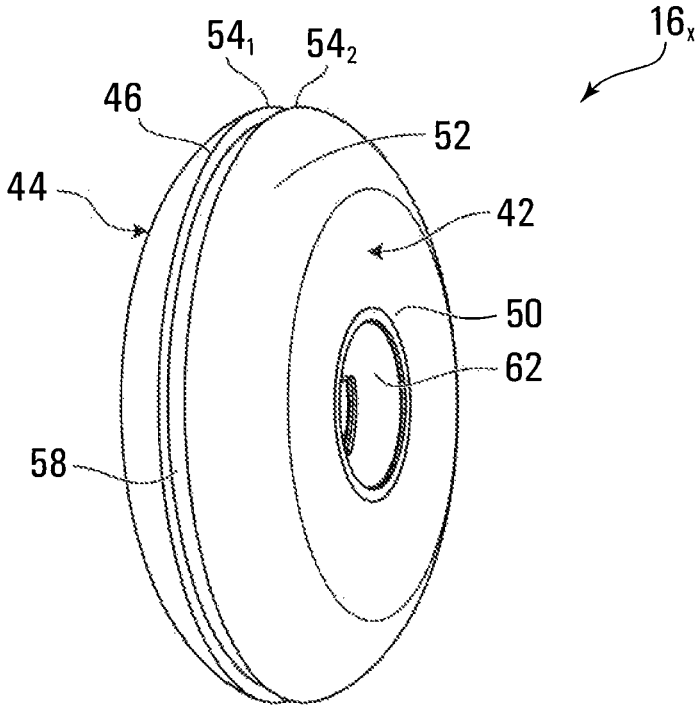
FIG. 3 is a perspective view of a wheel of the chassis.
Figure 4:
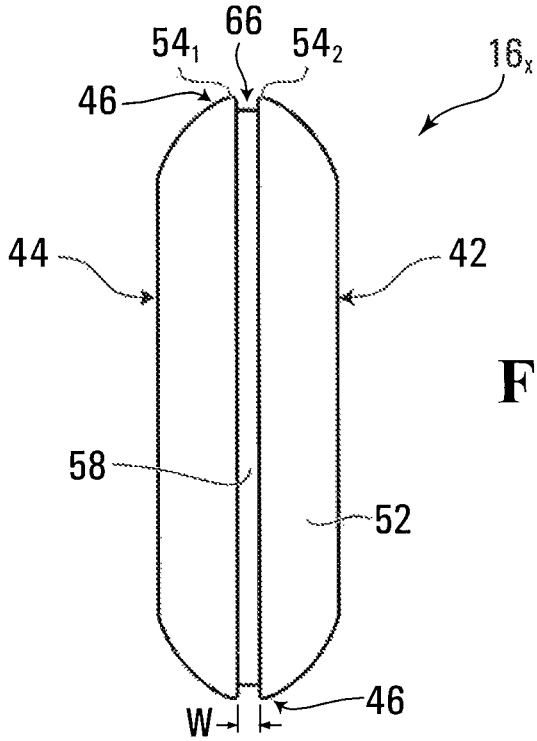
FIG. 4 is a front view of the wheel.
Figure 5:
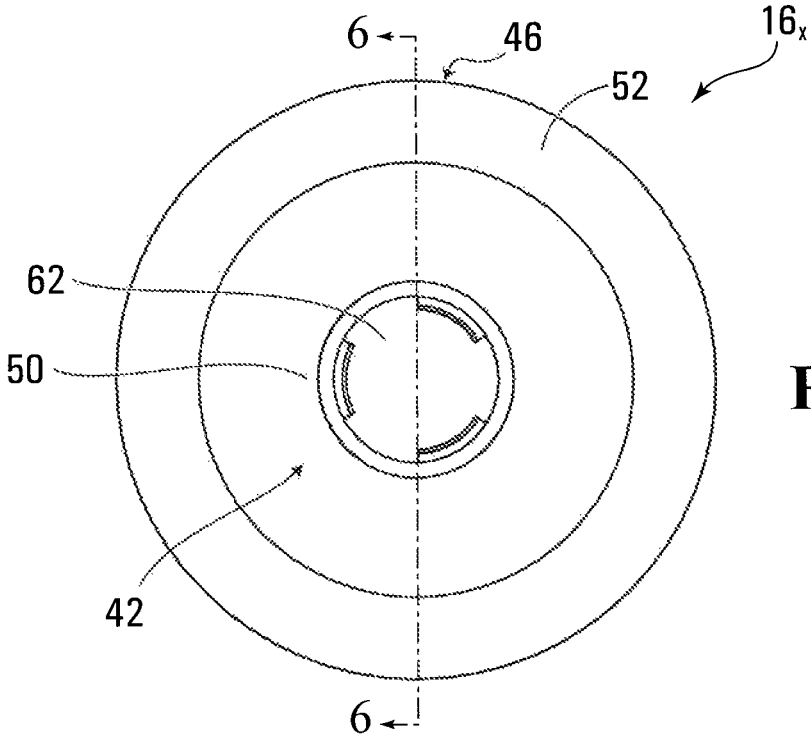
FIG. 5 is a side view of the wheel.

The chassis 14 comprises a frame 30 supporting the wheels $\mathbf{16}_1$-$\mathbf{16}_4$. In this embodiment, as shown in FIGS. 1 and 2, the frame 30 comprises two longitudinal members $\mathbf{90}_1$, $\mathbf{90}_2$ below the skate boot 12. The wheels $\mathbf{16}_1$-$\mathbf{16}_4$ are disposed between the longitudinal members $\mathbf{90}_1$, $\mathbf{90}_2$. The longitudinal members $\mathbf{90}_1$, $\mathbf{90}_2$ are interconnected by a transversal member 92 at their top.

In this example, the longitudinal members $\mathbf{90}_1$, $\mathbf{90}_2$ are connected to front and rear pedestals $\mathbf{100}_1$ and $\mathbf{100}_2$ which connect to the underside 102 of the skate boot 12. For example, in some embodiments, the front and rear pedestals $\mathbf{106}_1$, $\mathbf{106}_2$ and the skate boot 12 may be affixed together with fasteners (e.g., screws, bolts, nuts, rivets, etc.). The frame 30 may be configured and/or attached to the skate boot 12 in various other ways in other embodiments.

In one embodiment, the frame 30 may be formed as one piece. For instance, in some cases, the frame 30 may be cast or machined from metallic material (e.g., aluminum or steel). In another embodiment, different parts of the frame 30 may be formed separately and connected together via welding or any suitable manufacturing technique. The frame 30 may be made using various other materials and/or manufacturing processes in other embodiments.

The wheels $16_1$-$16_4$ roll on a skating surface 60 on which the inline skate 10 moves when the skater skates. The skating surface 60 may take on various forms in various cases. For example, in this embodiment in which the inline skate 10 is a roller hockey inline skate, the skating surface 60 may be a polymeric surface, a wooden surface or a treated cement surface. As another example, in other embodiments, the skating surface 60 may be a ground surface (e.g., asphalt).

The wheels $16_1$-$16_4$ are mounted to the frame 30 via holes that receive the wheels' axles. While in this embodiment the chassis 14 comprises four wheels $16_1$-$16_4$, the chassis 14 can be modified in order to accommodate a different number of wheels in other embodiments. The chassis 14 may also be designed for receiving wheels of different outer diameters (e.g., two rear wheels each having a greater diameter than the two front wheels).

With additional reference to FIGS. 3 to 7, each wheel $16_x$ comprises a first lateral surface 42, a second lateral surface 44, and a circumferential surface 46. The first lateral surface 42 and the second lateral surface 44 are opposite one another and define a width of the wheel $16_x$. The circumferential surface 46 extends between the first lateral surface 42 and the second lateral surface 44 along a circumference of the wheel $16_x$. The circumferential surface 46 is in rolling contact with the skating surface 60 when the skater skates.

More particularly, the wheel $16_x$ comprises a hub 50 and a wheel body 52. The hub 50 and the wheel body 52 form at least part of the first lateral surface 42 and the second lateral surface 44, while the wheel body 52 forms the circumferential surface 46.

The hub 50 is configured to receive an axle of the wheel $16_x$. To that end, the hub 50 comprises an opening 62 through which extends the axle of the wheel $16_x$. For example, in some embodiments, the opening 62 of the hub 50 may house a bearing 74 and a spacer 76 through which the axle of the wheel $16_x$ is to be received.

The hub 50 may be configured in any suitable way. For example, in some embodiments, the hub 50 may be generally annular and include a circumferential projection 64 surrounded by the wheel body 52. The hub 50 may include a plurality of spokes or a plurality of voids or may be full without any spoke or void. The hub 50 may have any other suitable configuration in other embodiments.

The hub 50 may be made of any suitable material. For example, in some embodiments, the hub 50 may be made of polymeric material (e.g., nylon) or metallic material (e.g., aluminum).

In this embodiment, the hub 50 is manufactured (e.g., by molding and/or machining) separately from and embedded into the wheel body 52. For instance, in one example of implementation, the hub 50 may be manufactured separately from the wheel body 52 then inserted in a central void of the wheel body 52. In another example of implementation, the wheel body 52 may be molded over the hub 52. In other embodiments, the hub 50 may be formed integrally with the wheel body 52.

The wheel body 52 extends radially from the hub 50 and defines the circumference of the wheel $16_x$. More particularly, the wheel body 52 forms the circumferential surface 46 of the wheel $16_x$. In this embodiment, the circumferential surface 46 comprises a first contact surface $54_1$ and a second contact surface $54_2$ for being in rolling contact with the skating surface 60 on which the inline skate 10 moves. The wheel body 52 also comprises a receding surface 58 extending from the first contact surface $54_1$ to the second contact surface $54_2$ and forming a recess 66 between these contact surfaces $54_1$, $54_2$. The contact surfaces $54_1$, $54_2$ and the recess 66 reduce rolling friction and provide a wider rolling base which gives more stability to the skater.

The contact surfaces $54_1$, $54_2$ and the receding surface 58, including the recess 66 it forms, may be configured in various ways.

Figure 6:
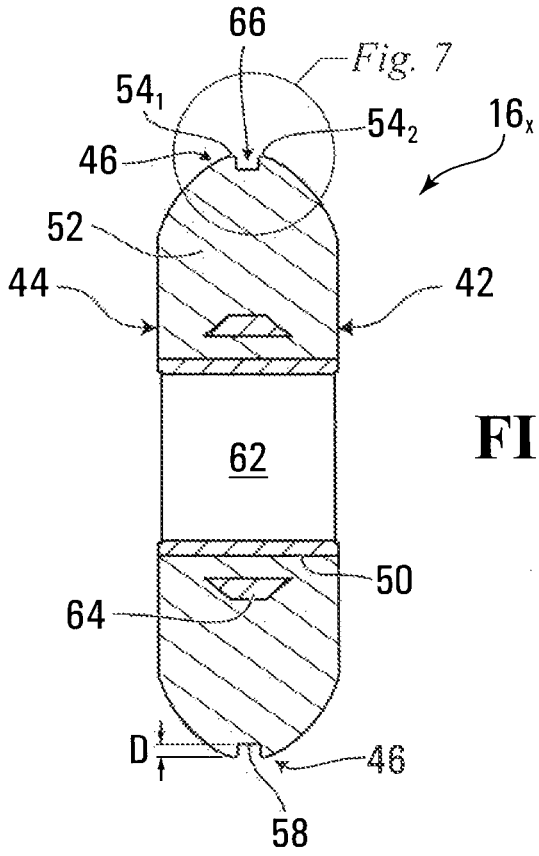
FIG. 6 is a cross-sectional view of the wheel.
Figure 7:
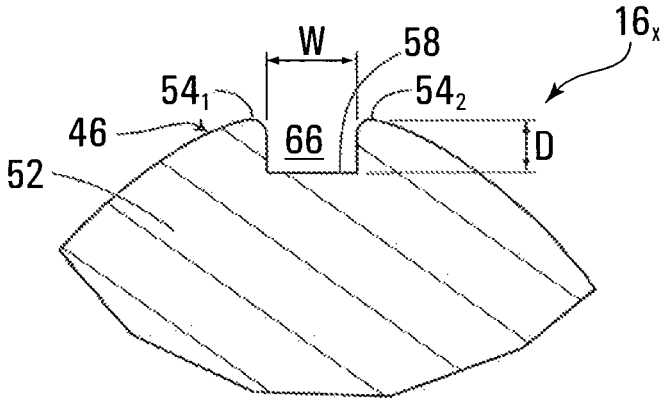
FIG. 7 is an enlarged view of a portion of a cross-section of the wheel.

For example, in the embodiment shown in FIGS. 3 to 7, the recess 66 is a groove extending along at least part of the circumference of the wheel $16_x$. More particularly, in this case, the groove 66 extends along an entirety of the circumference of the wheel $16_x$. Also, in this embodiment, the recess 66 is formed such that its receding surface 58 extends substantially perpendicularly to at least one, in this case both, of the contact surfaces $54_1$, $54_2$. Furthermore, in this embodiment, the receding surface 58 is generally cylindrical at a bottom 72 of the recess 66 such that it appears generally flat in a cross-section of the wheel $16_x$ (as shown in FIG. 6). The recess 66, the receding surface 58 and the contact surfaces $54_1$, $54_2$ may have various other shapes in other embodiments (e.g., the receding surface 58 may be curved at the bottom 72 of the recess 66 such that it appears concave, convex or otherwise curved in a cross-section of the wheel $16_x$, instead of being generally flat as shown in FIG. 6).

The recess 66 has a width W in a widthwise direction of the wheel $16_x$. For example, in some embodiments, the width W of the recess 66 may be at least 1 mm, in some cases at least 2 mm, in some cases at least 3 mm, and in some cases even more (e.g., up to 10 mm). The width W of the recess 66 may take on any other suitable value in other embodiments.

The recess 66 has a depth D in a radial direction of the wheel $16_x$. For example, in some embodiments, the depth D of the recess 66 may be at least 0.5 mm, in some cases at least 0.75 mm, in some cases at least 1 mm, in some cases at least 2 mm, and in some cases even more (e.g., up to 5 mm). The depth D of the recess 66 may take on any other suitable value in other embodiments.

For example, in some embodiments, a ratio W/D of the width W of the recess 66 to the depth D of the recess 66 may be between 0.2 and 20, in some cases between 0.5 and 10, and in some cases between 1 and 5. The ratio W/D of the width W of the recess 66 to the depth D of the recess 66 may take on any other suitable value in other embodiments.

The recess 66 may be created in various manners. For example, in one embodiment, the wheel body 52 may be molded and the recess 66 may be created by cutting it after the wheel body 52 has been molded. In another embodiment, the wheel body 52 may be molded and the recess 66 may be created during molding of the wheel body 52 using a suitably shaped mold.

The wheel body 52 may be made of any suitable material. For example, in this embodiment, the wheel body 52, including its circumferential surface 46, includes polymeric material. More particularly, in this embodiment, the wheel body 52 is a one-piece polymeric body that is continuous from the first lateral surface 42 to the second lateral surface 44 and from the hub 50 to the circumferential surface 46. For instance, in one embodiment, the polymeric material of the wheel body 52 may comprise polyurethane.

A hardness of the material of the circumferential surface 46 of the wheel body 52 can have any suitable value. For example, in some embodiments, the hardness of the material of the circumferential surface 46 of the wheel body 52 may be at least 74 A durometers (i.e., on the Shore A durometer scale) and in some cases between 74 A durometers and 84 A durometers. The hardness of the material of the circumferential surface 46 may take on any other suitable value in other embodiments.

The outer diameter of the wheel body 52 may have any suitable value. For example, in some embodiments, the outer diameter of the wheel body 52 may be between 59 mm and 80 mm. The outer diameter of the wheel body 52 may take on any other suitable value in other embodiments.

Although the wheel $\mathbf{16}_x$ is configured in a particular manner in embodiments considered above, the wheel $\mathbf{16}_x$ may be configured in various other manners in other embodiments.

Figure 8:
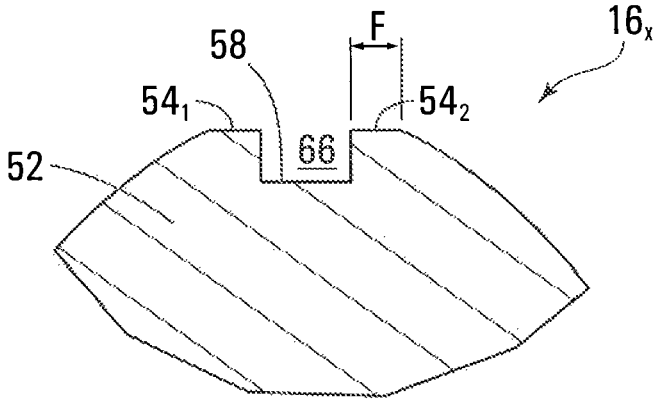
FIG. 8 is an enlarged view of a portion of a cross-section of a wheel in accordance with another embodiment of the invention.

For example, in another embodiment, as shown in FIG. 8, the contact surfaces $\mathbf{54}_1$, $\mathbf{54}_2$ may be generally flat in the widthwise direction of the wheel $\mathbf{16}_x$ to provide an even wider rolling base and an increased stability to the skater. A width F of general flatness of each of the contact surfaces $\mathbf{54}_1$, $\mathbf{54}_2$ can have any suitable value. For instance, in some embodiments, the width F may be at least 1 mm, in some cases at least 1.5 mm, in some cases at least 2 mm, and in some cases even more (e.g., up to 4 mm). The width F may take on any other suitable value in other embodiments.

As another example, in other embodiments, the recess 66 may be a groove that extends along less than all the circumference of the wheel $\mathbf{16}_x$. For instance, in some cases, the groove 66 may extend along at least one-quarter, at least one-third, or at least one half of the circumference of the wheel $\mathbf{16}_x$ without extending completely around the wheel $\mathbf{16}_x$.

Figure 9:
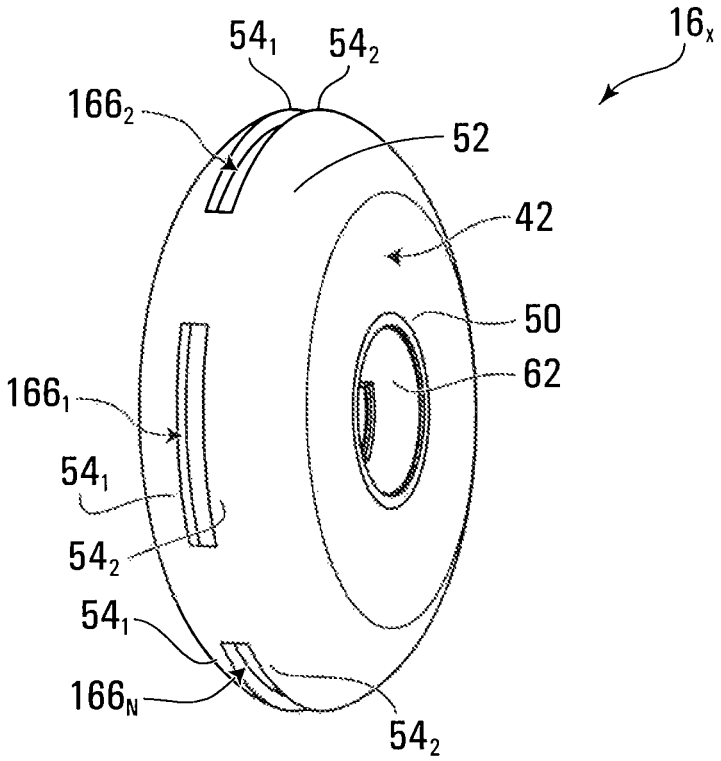
FIG. 9 is a perspective view of a wheel in accordance with another embodiment of the invention.

As yet another example, instead of including a single recess like the recess 66, in another embodiment, as shown in FIG. 9, the wheel body 52 may include a plurality of recesses $\mathbf{166}_1$-$\mathbf{166}_N$ spaced apart along the circumference of the wheel $\mathbf{16}_x$.

The above description of the embodiments should not be interpreted in a limiting manner since other variations, modifications and refinements are possible within the scope of the present invention. The scope of the invention is defined in the appended claims and their equivalents.

The invention claimed is:

1. A wheel for an inline skate, the wheel comprising:

(a) a hub for receiving an axle; and (b) a wheel body defining a circumference of the wheel, the wheel body comprising:

(i) a circumferential surface extending along the circumference of the wheel, the circumferential surface comprising a first contact surface and a second contact surface for being in rolling contact with a skating surface on which the inline skate moves, wherein each of the first and second contact surfaces is generally flat in a widthwise direction of the wheel; and (ii) a receding surface extending from the first contact surface to the second contact surface and forming a single groove between the first contact surface and the second contact surface, the single groove extending along at least part of the circumference of the wheel and having a width between 2 mm and 2.9 mm for reducing rolling friction, wherein the single groove is defined by first and second walls extending substantially perpendicularly from the first and second contact surfaces and by a bottom wall extending between the first and second walls and wherein the bottom wall and first and second walls of the single groove are generally flat.

2. The wheel defined in claim 1, wherein the single groove extends along an entirety of the circumference of the wheel.

3. The wheel defined in claim 1, wherein the single groove has a depth of at least 0.5 mm.

4. The wheel defined in claim 3, wherein the depth of the single groove is at least 0.75 mm.

5. The wheel defined in claim 4, wherein the depth of the single groove is at least 1 mm.

6. The wheel defined in claim 1, wherein the single groove has a depth in a radial direction of the wheel, a ratio of the width of the single groove to the depth of the single groove being between 1 and 10.

7. The wheel defined in claim 1, wherein a width of general flatness of each of the first contact surface and the second contact surface is at least 1 mm.

8. The wheel defined in claim 7, wherein the width of general flatness is at least 1.5 mm.

9. The wheel defined in claim 8, wherein the width of general flatness is at least 2 mm.

10. The wheel defined in claim 1, wherein each of the first contact surface and the second contact surface includes polymeric material.

11. The wheel defined in claim 10, wherein the polymeric material comprises polyurethane.

12. The wheel defined in claim 1, wherein the wheel body is molded and the single groove is molded during molding of the wheel body.

13. The wheel defined in claim 1, wherein the wheel body is molded and the single groove is cut into the wheel body after molding of the wheel body.

14. The wheel defined in claim 1, wherein the hub is embedded in the wheel body.

15. The wheel defined in claim 1, wherein each of the first contact surface and the second contact surface has a hardness of at least 74 A durometers.

16. The wheel defined in claim 15, wherein the hardness is between 74 A durometers and 84 A durometers.

17. An inline chassis for an inline skate, the inline chassis comprising a wheel as defined in claim 1.

* * * * *